United States Patent [19]

D'Haem et al.

[11] Patent Number: 4,791,836

[45] Date of Patent: Dec. 20, 1988

[54] RATCHET MECHANISM

[75] Inventors: Marcel P. D'Haem, New Hartford; Pradip K. Paul, Whitesboro, both of N.Y.

[73] Assignee: Chicago Pneumatic Tool Company, Utica, N.Y.

[21] Appl. No.: 34,083

[22] Filed: Apr. 1, 1987

[51] Int. Cl.[4] ..... B25B 13/46

[52] U.S. Cl. ..... 81/57.39; 81/57.13; 81/57.29

[58] Field of Search ..... 81/57.39, 57.11, 57.14, 81/57.3, 57.44, 57.29, 57.13, 60-63.2; 384/609, 111; 192/43, 43.1

[56] References Cited

U.S. PATENT DOCUMENTS

| | | | |
|---|---|---|---|
| 2,776,588 | 1/1957 | Livermont | 81/60 X |
| 3,621,738 | 11/1971 | Northcutt | 81/57.39 |
| 4,086,829 | 5/1978 | Hudgins | 81/57.29 X |
| 4,183,260 | 1/1980 | Wagner et al. | 81/57.39 X |
| 4,346,630 | 2/1982 | Hanson | 81/57.39 X |

FOREIGN PATENT DOCUMENTS

| | | | |
|---|---|---|---|
| 61663 | 5/1955 | France | 81/63 |

*Primary Examiner*—Debra Meislin

*Attorney, Agent, or Firm*—Charles L. Johnson, Jr.

[57] ABSTRACT

An improved ratchet wrench tool ratcheting mechanism is provided wherein springs encased in the shank spindle have balls at each end of the springs to abut fixed washer surfaces so that tool operation and life is improved by increasing the frictional force and reducing the spring stress, unbalanced load, and housing yoke wear experienced by prior art mechanisms.

3 Claims, 2 Drawing Sheets

RATCHET MECHANISM

BACKGROUND OF THE INVENTION

1. Field of the Invention

This invention relates to pneumatic ratcheting wrenches in general and to an improved ratcheting mechanism in particular.

2. Prior Art

Ratcheting mechanisms including pneumatically driven ratchet wrenches are well-known in the mechanical art.

In such prior art devices the ratcheting pawl engagement relies on the friction between spring loaded balls and flat unrestrained rotatable washers. Typically, springs are encased in a cavity within the shank spindle, one ball with each spring. Short-comings of this mechanism are that the spring is encased in a cavity within the shank spindle, the ball load working on the spring from one direction only, over stressing the spring and putting unbalanced load on the shank spindle causing wear on the opposite housing yoke, and with possible rotation of the washer surfaces causing loss of available ball friction. All of these effects combine to prematurely nullify the ratcheting engagement to make the tool inoperative.

SUMMARY OF THE INVENTION

The present invention embodies the principle of a floating spring design for the purpose of correcting the unbalanced load, reducing spring stress and increasing available friction drive on the ball and the flat surface interface.. The invention also involves the incorporation of two restrained and non-rotating flat surface washers, one at each end, to provide the friction surfaces for the balls at each end of the springs.

DETAILED DESCRIPTION OF THE INVENTION

Figure 1:
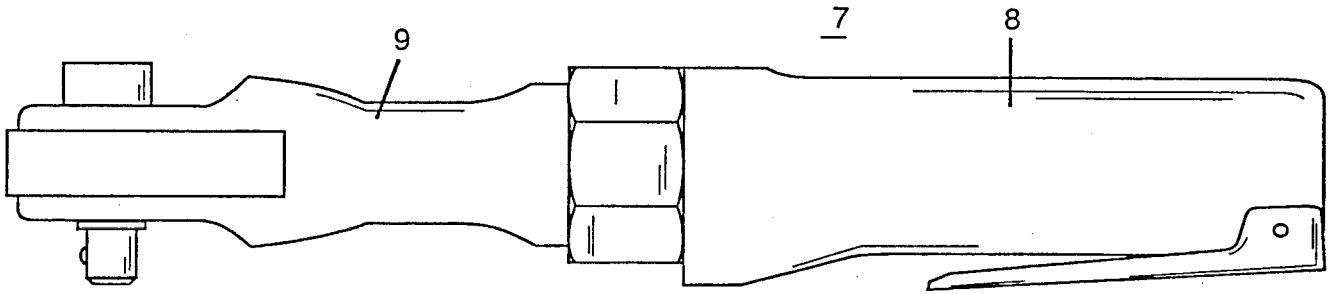
Fig. 1 (PRIOR ART)
FIG. 1 is an outline drawing of a pneumatic ratchet wrench.
Figure 2:
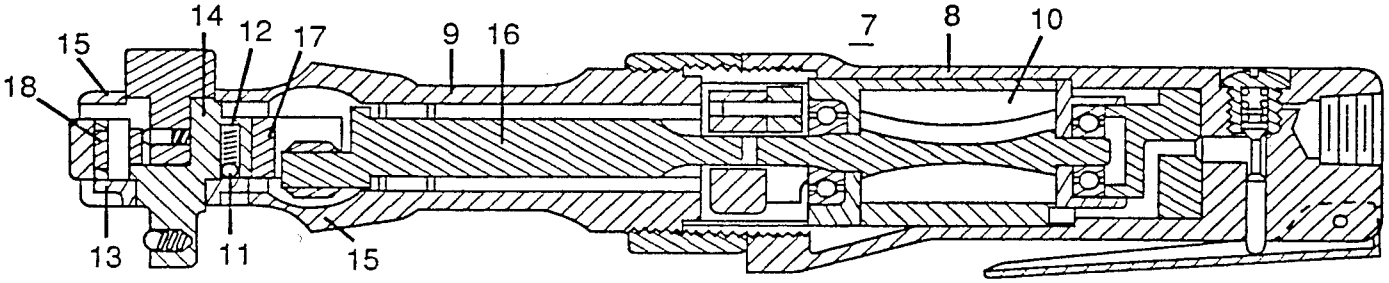
Fig. 2 (PRIOR ART)
FIG. 2 is a partial cross-sectional view of a conventional prior-art pneumatic ratchet wrench.

As a preface to the invention description, the prior art will be described by reference to FIGS. 1 and 2.

A pneumatic ratchet wrench 7 includes a housing 8 and 9 within which is an air motor 10, which drives a crankshaft 16. The output energy of the air motor 10 is converted to oscillating motion of ratcheting yoke 17 and then through a ratcheting pawl 18 to rotary motion of an output shank spindle 14.

The heart of the transfer mechanism, the ratcheting pawl 18 engagement with the output shank spindle 14, relies on the friction between two separate spring-loaded balls 11 and a flat unrestrained rotatable surface 13.

Short-comings of this mechanism are that the spring 12 is encased in a cavity within the shank spindle 14, the ball load working on spring 12 from one direction only, overstressing the spring and putting an unbalanced load on the shank spindle 14, causing wear on the opposite housing yoke 15. Possible rotation of washer surface 13 causes loss of available ball friction. All of these events combined, in effect, prematurely nullify the ratcheting engagement making the tool inoperative.

The present invention will be described by reference to FIGS. 3 and 4. The invention embodies a principle of floating spring 22 design for the purpose of correcting unbalanced load, reducing spring stress and increasing available friction drive at the ball 21 and the flat surface interface of washer 23. Still referring to FIG. 3, a ball 21 is located at each end of two springs 22, in holes through the shank spindle 24, making the spring 22 to "float" with load. The balanced nature of the load allows a direct transfer of part of the spring load onto the opposing housing yokes 25. This balanced load feature notably stabilizes friction values through variables of lubrication and "worn condition" through the working life increasing effective torque output. The two cantilever housing yokes 25 share part of the spring load and the stress, in effect reducing the stress in the coil spring 22 The shank spindle 24 therefore does not have any direct load from the spring-ball arrangement.

One feature of the invention involves the incorporation of two restrained or non-rotating flat surface washers 23, one at each end of the ball-terminated springs, to provide the friction surfaces for the balls 21 at each end of the springs. The non-rotating nature of the friction surfaces at either end of balls 21 increase the frictional force to ensure improvement in the engagement of ratcheting action. The frictional force can be quantified as two times frictional coefficient times normal force, compared to one times frictional coefficient times normal force in conventional design.

In one embodiment dowel pins 26 are used to restrain the rotation of the washers 23.

It should be understood that it is feasible to cast or otherwise form the non-rotating washer and surface with the housing yoke, as one piece.

Also, while the preferred embodiment incorporates two springs with a ball at each end of the two springs located on opposite sides of the shank spindle 24, the use of fewer balls and or more springs and balls would be within the scope of the invention. More than two floating springs 22 and associated balls would increase the frictional force.

Figure 3:
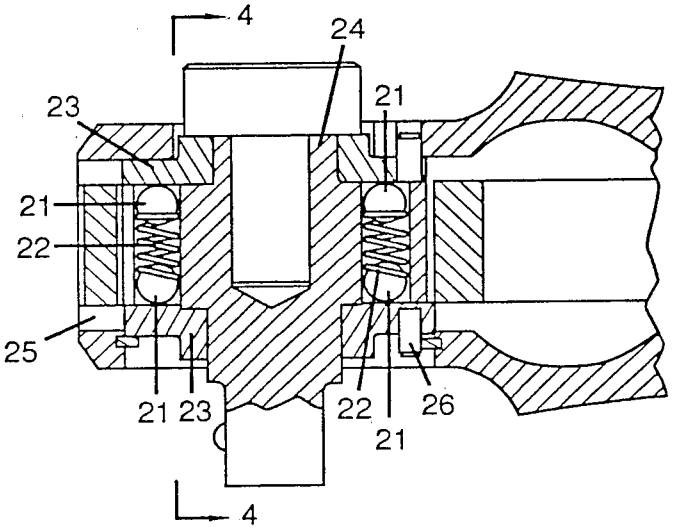
FIG. 3 is a cross-sectional view of the ratcheting mechanism of the invention.
Figure 4:
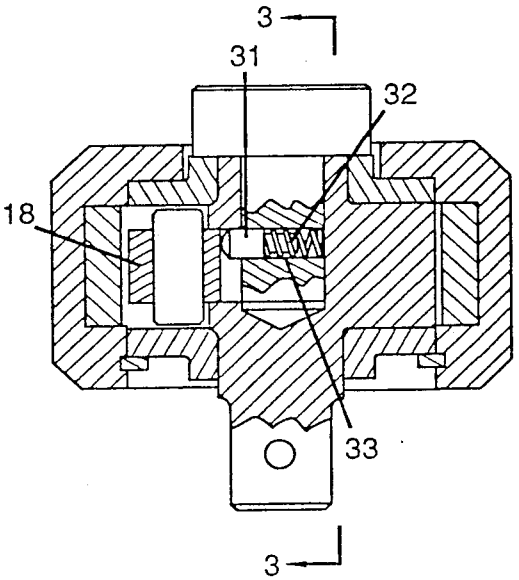
FIG. 4 is a cross-sectional view of the improved ratcheting mechanism along a plane 90° from the view shown in FIG. 3.

FIG. 4 is a cross-sectional view of the shank spindle arrangement of FIG. 3, taken at 90° from tee view of FIG. 3. FIG. 4 illustrates the arrangement of a pin 30, around which the ratchet pawl 18 pivots. Also, a force member 31 is urged against the ratchet pawl 18 by spring 32 in passage 33.

From the above it is seen that the improved ratchet wrench mechanism uses at least one floating spring and non-rotating washer members to reduce stress on the spring, increase frictional force between ball and washer, balance the load, minimize wear and thereby increase the efficiency and life of the ratchet mechanism.

What is claimed is:

1. An improved ratcheting mechanism for use in a ratchet wrench having a housing, a crankshaft within the housing, a ratcheting yoke driven by the crankshaft, and a shank spindle driven by a ratchet pawl, said ratchet said being driven by the ratcheting yoke, the improvement comprising a plurality of springs, each mounted in a through hole in the shank spindle, a ball located at each end of the springs, and non-rotatable washers abutting the balls and mounted between the housing yoke and the shank spindle on respective sides of the spindle.

2. An improved air ratchet wrench comprising a housing having a stationary housing yoke, an air motor within the housing, a crankshaft driven by the air motor, a ratcheting yoke driven by the crankshaft, a ratchet pawl which is driven by the ratcheting yoke and a shank spindle, mounted within the housing and the housing yoke, and driven by the ratchet pawl whereby rotation of the air motor causes movement of the shank spindle, two washers having washer surfaces mounted between the housing yoke and the shank spindle on respective sides of the spindle, the shank spindle having a plurality of through holes formed therein, a resilient spring within each of the through holes, and a ball between each end of said springs and the respective adjacent washer surfaces, said washers being non-rotatably mounted to the housing yoke whereby a balanced load is placed on the shank spindle and ball friction is maintained due to each of the non-rotating surfaces of the washers.

3. An improved air ratchet wrench comprising a housing having a stationary housing yoke, an air motor within the housing, a crankshaft driven by the air motor, a ratcheting yoke driven by the crankshaft, a ratchet pawl which is driven by the ratcheting yoke, and a shank spindle, mounted within the housing and the housing yoke, and driven by the ratchet pawl whereby rotation of the air motor causes movement of the shank spindle, washers having two washer surfaces mounted between the housing yoke and the shank spindle on respective sides of the spindle, the shank spindle having a plurality of through holes formed therein, a resilient spring within each of the through holes, and a ball between each end of said springs and the respective adjacent washer surfaces, said washers being separate from the housing yoke but secured to it to make the washers non-rotatable relative thereto, whereby a balanced load is placed on the shank spindle and ball friction is maintained due to each of the non-rotating surfaces and the washers.

* * * * *